US006817298B1

(12) United States Patent
Zharkov et al.

(10) Patent No.: US 6,817,298 B1
(45) Date of Patent: Nov. 16, 2004

(54) SOLID PROPELLANT GAS GENERATOR WITH ADJUSTABLE PRESSURE PULSE FOR WELL OPTIMIZATION

(75) Inventors: Alexander S. Zharkov, Biysk (RU); Vladimir V. Kodolov, Biysk (RU); Yuri I. Maksimovich, Biysk (RU); Victor I. Maryash, Biysk (RU); Ivan N. Gayvoronskii, Ramenskoye (RU); Nickolai I. Gribanov, Ramenskoye (RU); Vasilii P. Zalogin, Ramenskoye (RU); Vladimir D. Kroshchenko, Ramenskoye (RU); Vladimir I. Pavlov, Ramenskoye (RU); Norayr S. Sanasaryan, Moscow (RU)

(73) Assignee: GeoTec Inc., Boca Raton, FL (US)

( * ) Notice: Subject to any disclaimer, the term of this patent is extended or adjusted under 35 U.S.C. 154(b) by 321 days.

(21) Appl. No.: 09/680,077

(22) Filed: Oct. 5, 2000

Related U.S. Application Data

(60) Provisional application No. 60/194,678, filed on Apr. 4, 2000.

(51) Int. Cl.[7] ..... F42B 3/00; G42D 3/00

(52) U.S. Cl. ..... 102/312; 102/313; 102/317; 102/288; 102/289; 102/290; 166/63

(58) Field of Search ..... 102/312, 313, 102/317, 288, 289, 290; 166/63

(56) References Cited

U.S. PATENT DOCUMENTS

| | | | | |
|---|---|---|---|---|
| 404,053 A | * | 5/1889 | Quick | 102/288 |
| 3,090,436 A | | 5/1963 | Briggs | 166/63 |
| 3,174,545 A | | 3/1965 | Mohaupt | 166/36 |
| 3,332,349 A | * | 7/1967 | Schwoyer et al. | 102/317 |
| 3,391,739 A | * | 7/1968 | Venghiattis | 102/313 X |
| 3,422,760 A | * | 1/1969 | Mohaupt | 102/313 |
| 3,718,095 A | * | 2/1973 | Munger et al. | 102/289 X |
| 3,721,297 A | * | 3/1973 | Challacombe | 166/299 |

(List continued on next page.)

FOREIGN PATENT DOCUMENTS

| | | |
|---|---|---|
| RU | 2 018 508 | 8/1994 |
| RU | 2 047 744 | 11/1995 |
| SU | 933 959 | 6/1982 |

OTHER PUBLICATIONS

Shmid R.A. and Cooper P.W., *In Situ Evaluation of Several Tailored–Pules Well Shooting Concepts*, Paper SPE/DOE 8934, presented at the SPE/DOE Symposium on Unconventional Gas Recovery, Pittsburgh, PA, May 1980.

Cuderman J.F. and Northrop D.A., *A Propellant–Based Technology for Multiple Fracturing Wellbores to Enhance Gas Recovery: Application and Rsults in Devonian Shale*, paper SPE/DOE/GRI 12838, presented at the Unconventional Gas Recovery Symposium, Pittsburgh, PA, May 1984.

Swift R.P. and Kusubov A.S., *Multiple Fracturing of Boreholes By Using Tailored–Pulse Loading*, SPE Journal, 1982, No. 12, pp. 923–932, Dec. 1982.

*Primary Examiner*—Jack Keith
(74) *Attorney, Agent, or Firm*—Drinker Biddle & Reath LLP

(57) ABSTRACT

A gas-generator is disclosed to intensify output of oil, gas, including gas from coal formations, or metals extracted by underground leaching by breakage and thermo gas chemical treatment of the critical formation zone with gaseous combustion products from a solid propellant.

The rate of increase of gas pressure is raised and the effect on the formation is enhanced by assembling the gas generator using coated and bare charges in a selected ratio. The charges burn radially, so the coated charges, which burn only from the center outwards, burn for longer and with a rising output. A two-peaked pressure characteristic is thus obtained. A high-velocity igniter may also be used to give a third, early pressure peak.

12 Claims, 3 Drawing Sheets

U.S. PATENT DOCUMENTS 3,837,279 A * 9/1974 Cooke, Jr. ..... 102/317
4,474,715 A * 10/1984 Weber et al. ..... 102/289 X
4,530,396 A 7/1985 Mohaupt ..... 166/63
4,594,945 A * 6/1986 Alexandris ..... 102/290 X
4,683,943 A 8/1987 Hill et al. ..... 166/63
4,757,863 A * 7/1988 Challacombe et al. ..... 166/299
4,798,244 A * 1/1989 Trost ..... 102/317 X
5,005,641 A * 4/1991 Mohaupt ..... 166/63
5,355,802 A * 10/1994 Petitjean ..... 102/313
5,623,115 A * 4/1997 Lauritzen et al. ..... 102/289 X
5,712,445 A * 1/1998 Kassuelke et al. ..... 102/288
5,714,711 A * 2/1998 Schumacher et al. ... 102/289 X

* cited by examiner

SOLID PROPELLANT GAS GENERATOR WITH ADJUSTABLE PRESSURE PULSE FOR WELL OPTIMIZATION

This application claims foreign priority benefit from Russian Federation application No. 99121133, filed Oct. 6, 1999; and domestic priority from U.S. provisional application No. 60/194,678, filed Apr. 4, 2000.

FIELD OF THE INVENTION

The invention relates to a device useful in the oil-extracting and mining industry, and particularly to a device for the fracture and thermo-gas-chemical treatment of the critical formation zone in subterranean wells of various types, for example: to increase oil and gas output; for dehydration, degassing and methane extraction in coal formations; and for the extraction of metal by underground leaching.

The invention relates specifically to devices using the combustion of solid energy carriers, such as solid rocket fuel, to produce a pulse of hot, high pressure gas. The efficiency of such devices in improving the percolation characteristics of the critical formation zone depends on the number and extent of the fractures created. Those in turn depend on many factors, but primarily on the amplitude, duration, and dynamics of the pressure increase created by the combustion.

BACKGROUND OF THE INVENTION

Many devices are of this general type have been known and used. They are typically solid-propellant gas generators that are lowered into a well with a cable, and they vary in their design and in their effect on the rock formation. The following publications describe some examples and techniques for their use.

U.S. Pat. No. 3,174,545 discloses a device containing completely encased charges of granular powder, with a burning web up to 1 mm in thickness.

A device with a similar type of charge, working with a packer ring system, is described in J. F. Ruderman and D. A. Northrop, *A Propellant-Based Technology for Multiple Fracturing Well bores to Enhance Gas Recovery: Application and Results in Devonian Shale*, paper SPE/DOE/GRI 12838 presented at the Unconventional Gas Recovery Symposium, Pittsburgh, Pa., May, 1984. A test of an analogous device in a horizontal test hole is described in R. A. Schmidt, N. R. Warpinski, and P. W. Cooper, *In Situ Evaluation of Several Tailored-Pulse Well Shooting Concepts*, paper SPE/DOE 8934 presented at the SPE/DOE Symposium on Unconventional Gas Recovery, Pittsburgh, Pa., May 1980.

U.S. Pat. No. 3,422,760 describes a device in which a pulsed effect is achieved by successive ignition of several distinct charges.

U.S. Pat. No. 3,090,436 describes a device in which the gas pressure from the combustion of the propellant causes packers to expand and seal the well above and below a point at which the gas is released, concentrating the pressure in a narrow zone. It is usual for devices of this type to have a metallic or polychlorvinyl case. The pressure pulse produced by these devices is relatively brief (up to several milliseconds), and adjustment of the pressure pulse is effected by mixing powders of different sizes and forms in selected proportions, and by choosing an optimal weight for the charge.

U.S. Pat. No. 4,530,396 discloses a device that consists essentially of two cylindrical charges, end to end. Ignition takes place in a central channel by means of an electric igniter, optionally in combination with a quick-burning linear igniter. The first charge burns rapidly outwards from the center and produces an initial pressure pulse tens of milliseconds in length and of sufficient magnitude to break the rock formation. The second charge burns more slowly, either because it burns only from the end nearest the first charge or because it is of a slower burning material, producing an extended period for which the pressure is lower but sufficient to increase the size of fractures made by the initial pressure pulse. The first charge is made of granular powder encased in a sealed sheath, and the interspace between the powder granules is oil-filled. The lower second charge is made of nitrocellulose. As in the devices mentioned above, the disadvantages of this device include the difficulty of producing completely sealed charges of granular powder, and the possibility that a pressure pulse of small length and with a rapid pressure increase at the leading edge will have an adverse effect on crack formation.

Devices using solid-propellant charges and quick-burning powerful linear igniters are described in U.S. Pat. Nos. 4,683,943 and 5,005,641. In the first device, the charges have a protective external coating. Two propellant charges are spaced apart along the length of the well, and one of the propellant charges includes perforator charges to penetrate the well casing. The two charges are ignited simultaneously. The device thus produces a sudden pulse of pressure from the first charge when the charges ignite, followed by a second pulse when the pressure from the second charge travels along the well to the perforations. In the second device, the charge is in a metallic perforated case. Both devices are distinguished from the ones mentioned earlier in that their pressure pulse can be adjusted only by choosing the weight of the charge. They produce a lower rate of increase of pressure, but a pulse of effective pressure of greater duration, up to 100 ms. ("Effective pressure" is a pressure value which produces at least about 80% of the ground pressure necessary to produce artificial fractures.)

Operation of all of the gas generators mentioned above is characterized by a high rate of rise of the fracture-forming stress, in excess of $10^4$ MPa/s. In the opinion of American researchers, that causes multiple fractures to be formed. See *Pioneering New Concepts in Wifelike Conveyed Stimulation and Surveillance*, Hi Tech Natural Resources, Inc, 1991; and R. P. Swift and A. S. Kusubov, *Multiple Fracturing of Boreholes By Using Tailored-pulse Loading*, SPE Journal, 1982, No. 12, pp. 923–932.

A solid-propellant gas generator design is known, in which a detonation ignition system extends along the entire length of a central channel charge, which is used to increase the rate of rise of pressure and to form multiple fractures. See Haney B., Cuthill D., *Technical Review of the High Energy Gas Stimulation Technique*, Computalog Ltd, 1996. In this design, a powerful ignition pulse from fuse detonation products creates a developed system of new burning surfaces in charges. In consequence, the rate of rise of stress reaches $10^5$ to $10^6$ MPa/s, which produces typically 4 to 10 fractures in the rock seam. The charge diameter, amount of propellant, and energy of the ignition system energy vary, and can be optimized to get the best results in a particular well. The pulse length of effective pressure is generally from several ms to 100 or 200 ms. The charge is usually encased in a steel perforated case to be run into a well. However, since possibilities for adjusting the duration of effective pressure are limited, the length of fractures formed does not exceed 5 to 7 meters. Increasing the amount of propellant charge in the gas generator assembly leads to sharp increase in the peak explosion pressure and as a consequence to possible structural damage to the well.

Well pressure accumulators (WPA) are known in which a gas generator, consisting of an assemblage of bare charges of significant weight and length, is fired from below and above simultaneously by electric coils built-in on the ends of primary charges. See Tchazov G. A. and Azamatov V. V., Thermo-chemical Effect on Stripper and Complicated Wells, M., Nedre, 1986.

The absence of a pulse from a thermal igniter and the long time taken for the combustion front to spread upwards from the bottom of the well lead to a low rate of gas formation and a pressure pulse of long duration with a rate of increase of pressure, typically $$\frac{dP}{dt} \leq 10^2 \text{ to } 10^3 \text{ MPa/s.}$$

to $10^2$ to $10^3$ MPa/s. Gas generators of this type are mainly used for their effect on the zone of the rock formation adjoining the well, to clean colmatage out.

The use of bare charges with great initial burning surface and small burning web thickness gives substantially greater ability to adjust the rate of increase of pressure. For example, the use of charges with slots in the propellant mass or multi-tubular packaged pieces can increased $$\frac{dP}{dt}$$

to $10^4$ MPa/s. See USSR Inventor's Certificate No. 1704513 A1. However, the pulse length of effective pressure and, in consequence, the length of the fractures formed, remain inadequate with these constructions.

A gas generator with a detonation combustion system of tubular charges consisting of mixed solid propellant is proposed in Russian Federation Patent No. 2,018,508. Every charge has a combustion-inhibiting liner on the outside and a thin-walled metallic tube in the central channel. A detonating fuse extends the length of the generator assembly and is connected with a hermetically sealed explosive cartridge. This quick-burning gas generator generates comparatively high pressures in a short time, and breaks multiple fractures in the rock formation.

A similar gas generator in which the pressure pulse length can be adjusted is proposed in Russian Federation Patent No. 2,047,744. This generator has similar ignition charges in one or several groups. Over or between the ignition charges are propellant charges which have a thick-walled metallic tube in the central channel and which are ignited by hot gases from the ignition charges. The pulse length of effective pressure can be adjusted from ones to several hundreds of ms. A disadvantage of this gas generator is obstruction of the well by residues of the primary charge metallic tubes, which are broken by the detonation fuse into strips with tom edges and can render the well impassable for equipment to be used in further exploration. This generator is also highly metal-intensive and needs expensive mixed fuels.

Powder pressure generator PGDBK-100M is described in Russian Federation Patent No. 933,959. More than ten-thousand wells have been treated with this device in the Russian Federation and CIS countries. It is a precursor of the present invention. The PGDBK-100M generator consists of tubular powder charges with an inhibiting liner on the external surfaces. In the generator assembly, one of the central charges is a primary charge, in a central channel of which there is a completely enclosed metallic tube with an electric fuse and grains of a pyrotechnic compound. Powder grains are also installed in the central channel for the carrier cable in the remaining charges to increase burning surface.

The amount of the tubular powder charge depends on well conditions, collector type, and its mechanical and collecting properties, and is calculated by computer simulation based on nomograms and curves. See Beliaev B. M., Gribanov N. I. et al., *Operating Instructions for Pressure Powder Generators in Wells*, M., VIEMS, 1989, the entire contents of which are herein incorporated by reference.

A major disadvantage of the pressure generator described above is the low rate of increase of pressure with time, and the lack of opportunity to adjust that rate. The amount of the propellant charge is also limited by the structural strength of the well. Another disadvantage of that design is the metal-cased ignition device. Imperceptible moisture ingress into the device can lead to failure of the moisture-absorbing pyrotechnic grains to ignite.

Furthermore, ignition devices of that sort provide a "soft" ignition mode of the primary charge at the expense of local heating of the metallic tube to high temperatures. The "soft" ignition mode produces a pulse with a rate of increase of pressure of the order of $$\frac{dP}{dt} \leq 10^2 \text{ to } 10^3 \text{ MPa/s,}$$

which is not very high and tends to form an isolated pair of fractures in the rock seam.

To sum up this review of known solid-propellant gas generator designs which are capable of generating high pressure sufficient to form cracks, the following may be noted.

U.S. gas generator developments using granular powders and solid propellant have led to the creation of encased devices generating rapid, short-lived pulse pressures, forming a multitude of small length fractures in rock.

Russian gas generator developments have led to the creation of bare-charge devices using solid-propellant tubular charges, after the combustion of which essentially only the load-carrying cable is retrieved to the surface.

Gas generators with quickly and slowly during charges are known which are respectively able to form a multitude of short fractures or isolated long fractures.

An object of the invention is to provide a solid-propellant gas generator with a pressure pulse that can be adjusted for well optimization, and which is capable of increasing the rate of rise of pressure in a well.

In a gas generator according to one aspect of the invention, between a primary charge located at the bottom of the gas generator assembly and a known length ($H_{inh}$) of clad charges, there is a defined length (H) of bare tubular powder charges or other charges with a large initial burning surface.

BRIEF DESCRIPTION OF THE DRAWINGS

FIG. 3 A—A is a cross-section view along the line A—A in FIG. 3.

DETAILED DESCRIPTION OF THE DRAWINGS

Figure 1:
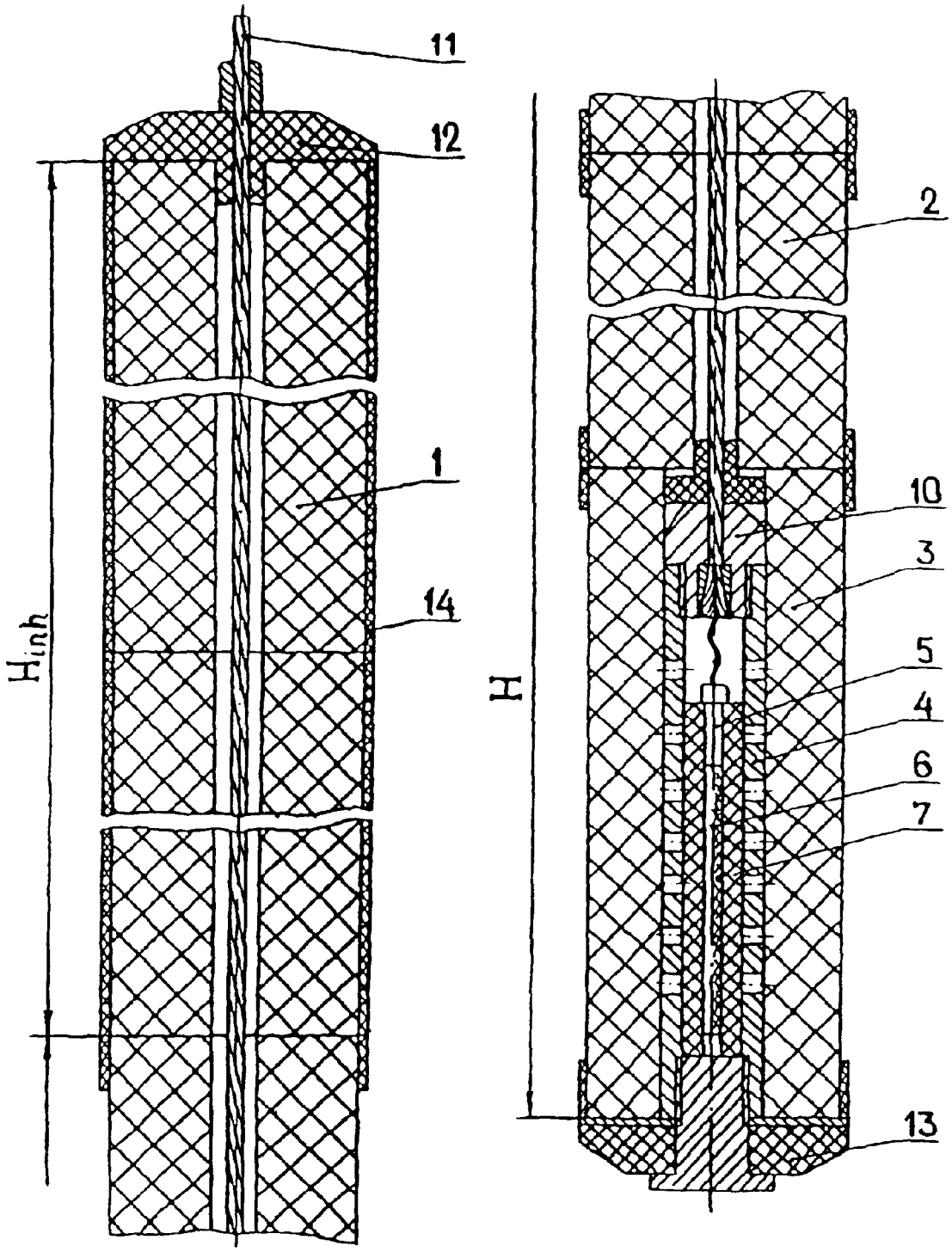
FIG. 1 is an axial section through a first embodiment of a gas generator in accordance with the invention.

FIG. 1 shows one embodiment of the gas generator according to the present invention. The gas generator is composed of cladded tubular charges 1 of outside diameter $D_0$, each charge having a central channel of diameter $d_0$, and of bare tubular charges 2 of outside diameter $D_0$ and having a central channel of diameter $d_0$. The bottom charge is a primary charge 3, which has a central channel of larger diameter than the central channels of the other charges, containing an igniter. Within the central channel is a perforated aluminum tube 4, secured at its upper end to a cable attachment head 10 and at its lower end to an end-cap 13 that covers, protects and supports the lower end of the gas generator. The cable attachment head 10 and the lower end-cap 13 may be screwed onto the tube 4. Within the perforated tube 4 are a primary cartridge 5, and an incendiary fuse or detonation wire 6, surrounded by an increment flash charge 7 of porous, very fast-burning material. The generator is supported, lowered, and raised on a geophysical cable 11 that is attached to the head 10, and the charges are clamped between the lower end-cap 13 and an upper end-cap 12 that is secured to the cable 11 by a lock-nut.

The clad charges 1 are covered by a combustion-inhibiting covering 14 made of a fireproof, but easily destroyed material which does not obstruct the well.

The combustion-inhibiting covering 14 may be a thin layer, typically about 1 mm thick, of incombustible material that is strongly bonded to the propellant charge, so as to become effectively integral therewith. As an example, in this embodiment the cladding 14 may be a thin cotton tape impregnated with an epoxy compound, wound onto the surface of the charge and then cured. The joints between the bare charges are provided with protective belts that ensure the alignment of the charges and protect the vulnerable edges of the charges, in order to provide safe and reliable lowering of the generator down the well.

Figure 3:
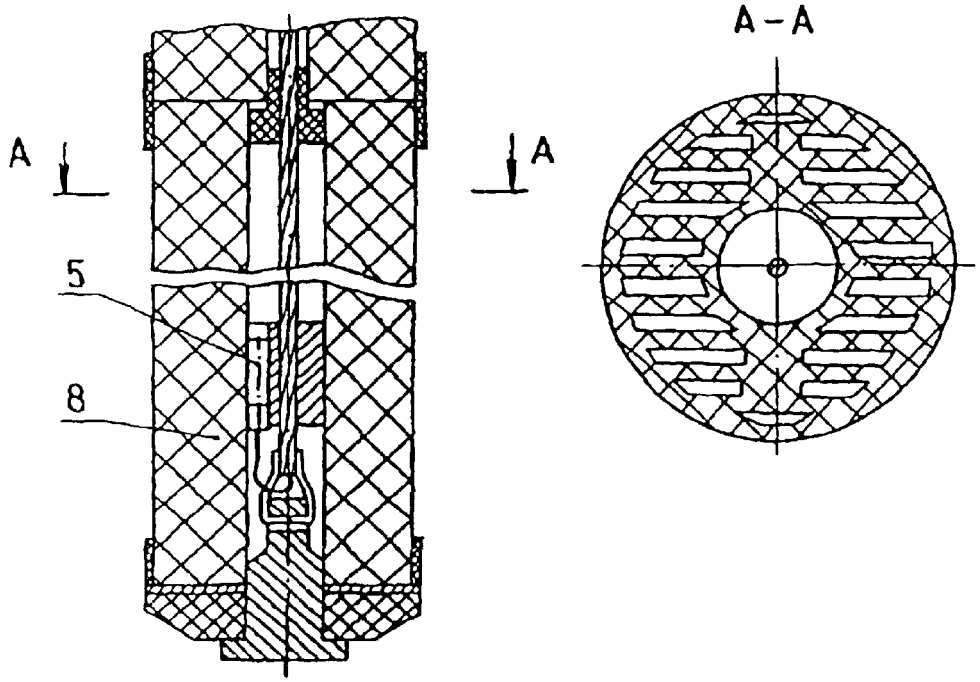
FIG. 3 is an axial section view, similar to part of FIG. 1, through a second embodiment of a gas generator in accordance with the invention.

Referring to FIG. 3, a second embodiment of the gas generator is similar to the first embodiment shown in FIG. 1 except that the primary charge 8 is a multi-tubular or slotted charge having a larger burning surface. The slotted charge is ignited directly by a primary cartridge 5 held against the primary charge on one side of the central channel.

Figure 4:
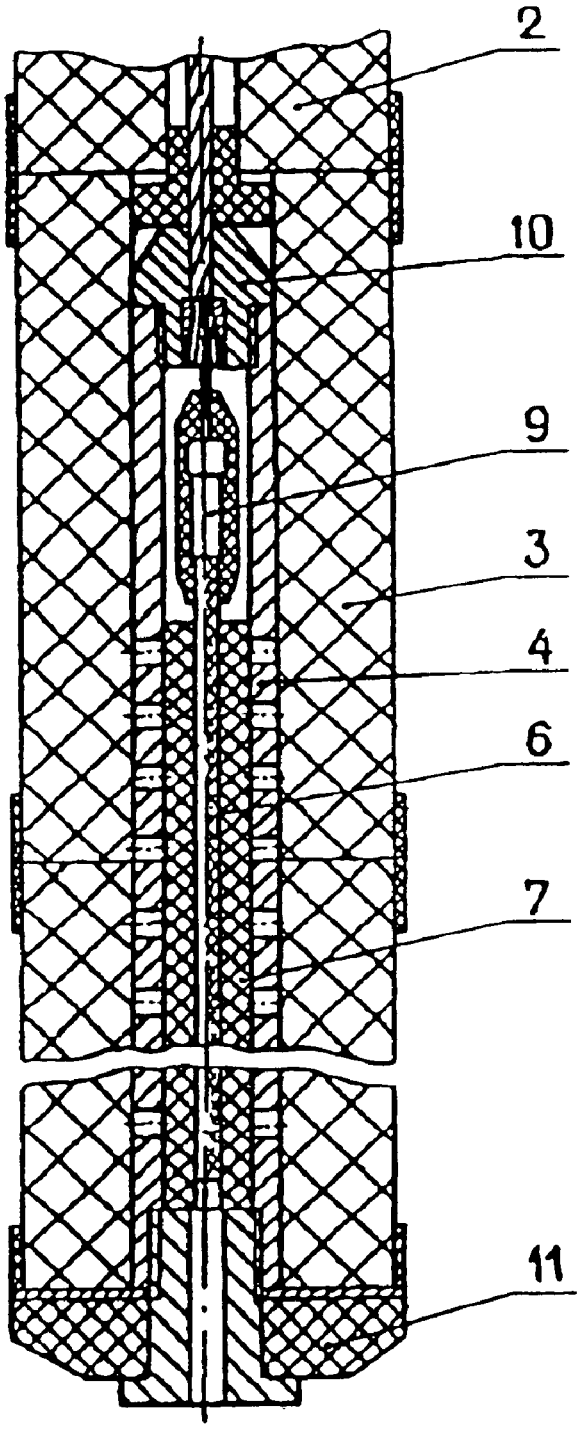
FIG. 4 is a view similar to FIG. 3 of a third embodiment of a gas generator in accordance with the invention.

Referring to FIG. 4, a third embodiment of gas generator is similar to that shown in FIG. 1, except that it has a detonating ignition system. Within the central channel of the primary charge 1 is a tube 4, which is perforated over part of its length. A detonating cord 6 and an increment flash charge 7 made of mixture propellant are disposed within the perforated part of the tube 4. Instead of the primary cartridge 5 shown in FIG. 1, an explosive cartridge 9 equipped with a rubber cover is disposed within an unperforated part of the tube 4. The explosive charge 9 is arranged to ignite one end of the detonating cord 6, which projects from the flash charge 7. The rubber cover prevents the explosive charge 9 from immediately destroying the tube 4. This design of the ignition device allows the use of a ballistite propellant composition in the primary charge without the risk that the igniter will cause the ballistite to detonate.

These gas generators are designed to work in wells filled with liquid under high hydrostatic pressure. Tests have been conducted with exploding the detonating fuse in the central channel of a model charge of incombustible material, having physical and chemical properties very similar to those of the solid propellant, in a well shaft of limited cross-section. The tests demonstrated that a detonating cord containing 40–50 g. of substance per meter of length did not break up the charge into separate fragments, but caused a network of radial and concentric non-through fractures within the solid charge.

Operation of the Gas Generator:

A gas generator according to the invention is assembled on-site at the well mouth, from prefabricated components in the form of bare charges, clad charges, a primary charge, and an igniter. The primary charge has a larger central bore than the other charges to receive the igniter tube. The gas generator may require as many as forty charges, depending on the geology and the well conditions. Each prefabricated charge section is approximately 1 meter long. The igniter may already be assembled with a length of wifelike 11 fixed in the cable attachment head 10, and the cable attachment head and the lower end-cap 13 screwed onto the tube 4. In that case, the generator may be assembled by threading the primary charge 3 onto the wifelike 11 and over the igniter, then threading the bare charges 2 and the clad charges 1 onto the wifelike, then positioning and securing the top end-cap 12. The assembled gas generator is lowered into the desired position within the well on the wifelike 11. A calculated amount of fluid, with any desired added chemicals, may also be added to the well.

A generator at the surface gives an electrical impulse to the ignition cartridge 5 (FIGS. 1 and 3) or the explosive cartridge 9 (FIG. 4). The electrical impulse releases a spring-loaded mechanical plunger, which strikes a blasting cap in the ignition cartridge. When the cartridge 5 ignites, it ignites the detonation wire 6, which ignites the increment flash charge 7. The increment flash charge 7 directly ignites the inner surface of the primary charge 3. Their combustion products, in the form of a gas at a temperature of about 2500° C. (4500° F.) spread through the originally available gaps in the generator structure, and ignite the primary charge 3, including the outer surface thereof. When the alternative explosive cartridge 9 is used, the fuse 6 detonates and its combustion products ignite the increment flash charge 7, which ignites the primary charge 3.

Combustion products of the primary charge 3 ignite both the inner and outer surfaces of the bare charges 2 installed above the primary charge. The coated charges 1 forming the upper part of the gas generator then also start to burn, but only at the inner surface. Thus, combustion of the bare charges 2 takes place in the inner channel and on the outer surface simultaneously and lets the main fire front diffuse into the charge in parallel layers from the central channel and from the outside surface. Combustion of the coated charges 1 starts up almost simultaneously through the whole central channel surface, but the main fire front spreads in parallel layers only from the central channel towards the outside surface.

When the charge combustion energy generated per time unit exceeds the energy lost in heat, in lifting up and otherwise displacing the liquid filling the well, and in expansion of combustion products into the formation, the pressure within the well increases. Under certain ratios of well, formation and mining pressures the conditions for the opening of natural fractures or for the creation of artificial fractures are produced. Such artificial fractures do not later fully close.

According to the applicants' estimates the fractures, and also the thermal, physical, and chemical influence of the gases produced on the mineral formation can spread over a radius of up to 15 meters or more.

Figure 2:
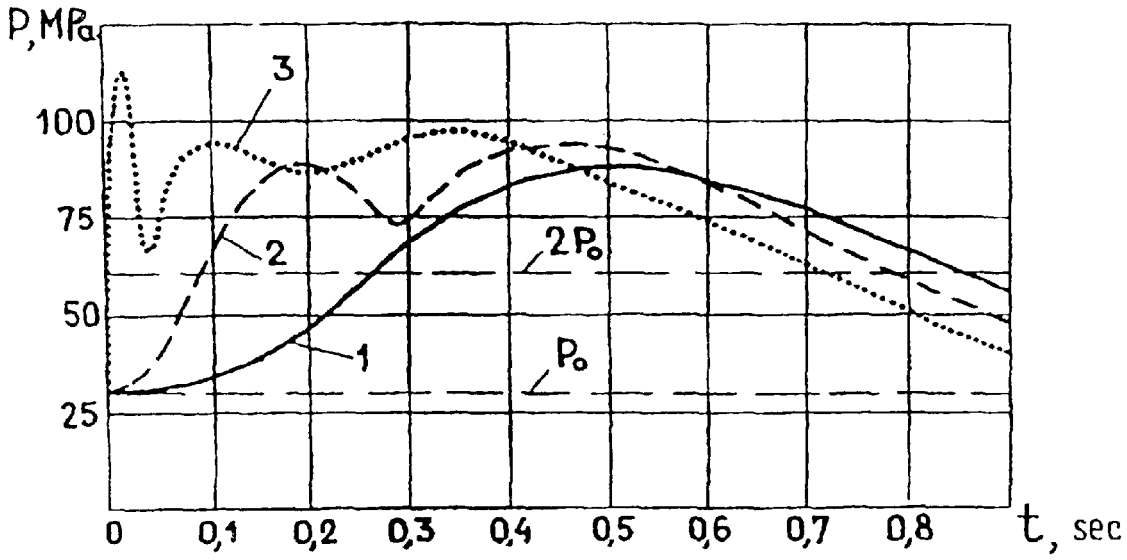
FIG. 2 is a graph of pressure against time for three different gas generators.

FIG. 2 is a graph showing pressure as a function of time for the following three different gas generators.

Curve 1 illustrates the combustion of a coated charge 2 meters in height with a flame igniter. There is a slow rise in pressure to a single pressure peak at approximately 500 ms. This type of gas generator is known in the art.

Curve 2 illustrates combustion of a gas generator according to the invention, with a bare primary charge 1 meter in height and a coated charge 2 meters in height, and the same flame igniter as the generator for curve 1. There is an initial pressure peak at approximately 200 ms produced by combustion of the bare charge, followed by a second peak at approximately 450 ms produced by combustion of the coated charge.

Curve 3 illustrates combustion of a gas generator according to the invention, with a bare charge having an enhanced (slotted) burning surface, as shown in FIG. 3, immediately above the primary charge, then one or more solid bare charges, then one or more coated charges, using a detonating igniter as shown in FIG. 4. The slotted charge produces a strong initial pressure pulse at about 10 ms, followed by pulses at 100 ms from the bare charges and 350 ms from the coated charges.

As shown by FIG. 2, the timing and rate of combustion produces pressure pulses, which enhance the efficiency of the treatment because the fluctuating stresses tend to break down the walls of fractures and debris. The strong initial pulse of curve 3, in particular, may serve to create or open fractures that are then expanded by the longer second and third pressure pulses.

These devices enlarge the options for producing a planned formation effect by estimating the rock loading velocity from their physical properties and the increase in force effect duration, which can reach 1 to 1.5 s (proceeding from practically existing linear propellant combustion velocities and geo-technical well characteristics) under a central ignition system.

A preferred relationship between a defined length (H) of bare tubular powder charges (or other charges with a large burning initial surface) located at the bottom of the gas generator assembly and a known length ($H_{inh}$) of clad charges may be determined as follows:

The rate of rise of gas pressure during combustion of the propellant charge is determined from the equation:

$$\frac{dP}{dt} = \frac{\frac{(1-\varphi)\cdot f}{\rho_n \cdot P}\cdot\frac{dm}{dt} - \gamma\left(S_c\cdot v + \frac{dV_T}{dt}\right)}{V_\psi + V_T + S_c x}\cdot P \tag{1}$$

where $\phi$ is a factor correcting thermic losses;

f is powder force (gas volume produced as a multiple of solid powder volume);

$\rho_\pi$ is powder density;

m is powder charge weight;

$S_C$ is well section area;

v is boundary velocity between combustion products and drilling fluid;

x is distance covered by the boundary between combustion products and drilling fluid;

$V_T$ is volume of fractures formed in formation;

$V_\psi$ is volume taken up by powder charge burnt; and $$\gamma = \frac{\Delta P}{pc},$$

where $\Delta P$ is the increase in pressure; and pc is acoustic stiffness.

It will be found that $$\frac{dV_T}{dt}$$

proportional to $\Delta P$.

The rate of loss of mass of the tubular powder charge as it burns is given by:

$$\frac{dm}{dt} = r_p U S(t) = r_p U_1 \frac{P}{P_1} S(t) \tag{2}$$

where: U is current burning velocity;

$U_1$ is burning velocity at $P=P_1$; and

S(t) is current burning surface.

It follows from equation (1) and (2), that $$Q_0 = \frac{dP}{dt}\Big/_{t=0} = K_1 \frac{S_0}{S_c} \tag{3}$$

$$\Delta P_{\max} = P_t - P_0 = K_2 \frac{S_t}{S_c}$$

at time $\tau$ when $$\frac{dP}{dt} = 0 \tag{4}$$

where $K_1$ and $K_2$ are proportionality factors, determined from equations (1) and (2); and $S_0$ and $S_\tau$ are burning surfaces at t=0 and at $t=\tau$, when $\Delta P_{max}$ is achieved.

With a gas generator according to the present invention, combustion initially takes place burning outwards from the central channel of both the bare and the clad charges, and inwards from the outer surface of only the bare charges. Combustion of the bare charges ceases when the two combustion fronts meet, at a diameter of $D_0+d_0/2$, where $D_0$ and $d_0$ are the initial outside and inside diameters of the tubular charge. Combustion of the clad charges continues, with the mass or volume rate of combustion increasing as the diameter, and therefore the area, of the combustion front increases, until the combustion front reaches the outer surface of the charge at diameter $D_0$. It follows from equation (4) that to achieve the same maximum pressure difference $\Delta P_{max}$ at the end of clad charge combustion as was achieved at the end of bare charge combustion the following condition is necessary:

$$\Pi\cdot(D_0+d_0)\cdot H + \Pi\frac{D_0+d_0}{2}\cdot H_{inh} = \Pi D_0 H_{inh}. \tag{5}$$

For a known pressure generator with combustion on a single cylindrical front (the right-hand side of equation (5)

is equivalent to such a generator) the actual length of charge necessary to achieve a given pressure P is determined, with a precision sufficient for practical purposes, by:

$$H_{inh} = \frac{P - (1 + a_0) \cdot P_0}{2K(1 - a_0) f \rho_x} \cdot D \tag{6}$$

where: $a_o$=0.8 to 0.9;

K≈(0.9 to 12).$10^{-3}$; and

D is the diameter of the well.

Hence it follows that $$\lambda = \frac{H}{H_{inh}} = \frac{D_0 - d_0}{2(D_0 + d_0)}, \tag{7}$$

where: λ is the ratio of the total lengths or total weights of bare and clad charges, the two ratios being equivalent where, as here, the bare and clad charges are of identical cross section.

For $D_o$>>$d_o$, equation (7) gives λ=0.5.

After bare charge combustion is completed, the pressure decreases somewhat, and then reaches the same difference $P_{max}$ in consequence of the increasing rate of combustion of the clad charges.

In accordance with equation (3), the initial rate of rise of pressure at time t=0 increases by a factor of n as compared with a conventional tubular charge of length $H_{ihn}$ burning only from the inside, where:

$$n = \frac{Q_0}{Q_{0_{inh}}} = \frac{S_0}{S_{0_{inh}}} = \frac{\Pi(D_0 + d_0) \cdot H + \Pi d_0 H_{inh}}{\Pi d_0 H_{inh}} = \frac{D_0 + d_0}{2d_0} \tag{8}$$

Curves for P(t) calculated by computing are shown in FIG. 2 for a known powder charge of $H_{inh}$=2 meters (curve1) and for a charge according to the invention with H=1 meter and $H_{inh}$=2 meters (curve2) in a well under a hydrostatic pressure $P_0$=30 MPa If, for example, slotted and/or multi-tubular charges with a large burning surface are used as bare charges, equation (5) becomes:

$$\frac{m}{\rho_\pi e} + \Pi \cdot (d_0 + 2e) \cdot H_{inh} = \Pi D_0 H_{inh} \tag{9}$$

where: m is weight of bare charges, and e is burning charge web thickness.

Hence, defining λ as the ratio of the weights of the bare and lined charges, rather than the ratio of their lengths, it follows that:

$$\lambda = \frac{m}{m_{inh}} = \frac{4(D_0 - d_0 - 2e) \cdot e}{D_0^2 - d_0^2} \tag{10}$$

Thus, the combination of clad and bare charges in the proportion determines the rate of rise of pressure to be increased several-fold. If the sealed ignition device is also replaced by a non-sealed device with an incremental flash charge (as in FIG. 1) giving direct fire force on the solid propellant of one or two primary gas generator charges with widespread initial burning surface, as shown in FIG. 3, the rate of rise of pressure can be increased by a factor of 10.

A still greater rate of rise of pressure is achieved by using a detonating igniter as shown in FIG. 4 with an explosive cartridge, detonating fuse and increment flash charge of mixture propellant which are installed in a perforated case. The operation of such a device creates a network of radial and concentric fractures in the combustible propellant charge, and the increment flash charge initiated by detonation products from the fuse gives a greater amount of combustible gas under high pressure. Combined with charge of widespread initial burning surface, as shown in FIG. 3, a pressure rise of $$\frac{dP}{dt} \leq 10^4 \text{ to } 10^5 \text{ MPa/s}$$

(see curve 3 in FIG. 2), which is necessary for multi-fracture breakage, may be achieved.

Computer-simulation of charge combustion under different well conditions shows the gas generators according to the present invention can be expected to exceed the known generators by 20–30% in seam attack duration and consequently form longer fractures.

What is claimed is:

1. A solid-propellant gas generator for well stimulation, comprising:

a tubular assembly of propellant charge having an outside surface and a central channel part of the assembly being clad on its outer surface to prevent burning from that surface, and part of the assembly being bare on its outer surface, wherein the propellant charge comprises a plurality of cylindrical charges stacked end to end, and wherein at least one of the charges is clad and at least one of the charges is bare; and an igniter arranged to initiate burning of the propellant charge along the whole length of the central channel and the bare part of the outer surface.

2. A gas generator according to claim 1, wherein the at least one clad charge is covered by a layer of substantially incombustible material adhering to the surface of the charge.

3. A gas generator according to claim 2, wherein the cladding layer on the least one clad charge overlaps and protects the end of an adjacent bare charge.

4. A gas generator according to claim 2, wherein there are a plurality of adjacent bare charges, and the join between them is encased in a protective ring.

5. A gas generator according to claim 1, which comprises a primary charge having the igniter positioned within its central channel.

6. A gas generator according to claim 5, wherein the primary charge is a bare charge.

7. A gas generator according to claim 5, wherein the diameter of the central channel of the primary charge is greater than that of other charges.

8. A solid-propellant gas generator for well stimulation, comprising:

a tubular assembly of propellant charge having an outside surface and a central channel, part of the assembly being clad on its outer surface to prevent burning from that surface, and part of the assembly being bare on its outer surface; and an igniter arranged to initiate burning of the propellant charge along the whole length of the central channel and the bare part of the outer surface;

wherein the propellant charge comprises a plurality of cylindrical charges stacked end to end, and wherein at least one of the charges is clad and at least one of the charges is bare;

which comprises a plurality of clad charges and a plurality of bare charges, and wherein all the clad charges are adjacent and all the bare charges are adjacent.

9. A gas generator according to claim 8, wherein the igniter is positioned within the endmost bare charge.

10. A solid-propellant gas generator for well stimulation, comprising:

a tubular assembly of propellant charge having an outside surface and a central channel, part of the assembly being clad on its outer surface to prevent burning from that surface, and part of the assembly being bare on its outer surface; and an, igniter arranged to initiate burning of the propellant charge along the whole length of the central channel and the bare part of the outer surface;

comprising an attachment for a cable to lower the gas generator into a well; and wherein the igniter is at a lower end of the gas generator, and is provided with an attachment for a cable passing along the central channel.

11. A gas generator according to claim 10, comprising a lower end cap attached to the igniter.

12. A gas generator according to claim 11, comprising an upper end cap with an attachment for the cable, and arranged to hold the cable in tension in the channel and the charge in compression.

* * * * *